US012768236B1

(12) United States Patent
Younger et al.

(10) Patent No.: US 12,768,236 B1
(45) Date of Patent: Oct. 20, 2026

(54) WIRELINE RECOVERY TOOL

(71) Applicant: SAUDI ARABIAN OIL COMPANY, Dhahran (SA)

(72) Inventors: Rae Andrew Younger, Westhill (GB); Jamie Cochran, Westhill (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/346,207

(22) Filed: Sep. 30, 2025

(51) Int. Cl.
*E21B 31/12* (2006.01)

(52) U.S. Cl.
CPC ..... *E21B 31/125* (2013.01)

(58) Field of Classification Search
CPC ..... E21B 31/00; E21B 31/20; E21B 31/18; E21B 31/125; E05B 81/46
See application file for complete search history.

(56) References Cited

U.S. PATENT DOCUMENTS

| | | | | |
|---|---|---|---|---|
| 487,946 | A | 12/1892 | Edwards, Jr. et al. | |
| 4,282,442 | A * | 8/1981 | Massinger | F16H 25/122 74/810.1 |
| 4,760,741 | A | 8/1988 | Koopmans et al. | |
| 7,946,198 | B2 | 5/2011 | Gui et al. | |
| 8,214,963 | B2 | 7/2012 | Yu | |
| 11,306,749 | B1 | 4/2022 | Raymond | |
| 2006/0048591 | A1 | 3/2006 | Veremkroit | |
| 2010/0298838 | A1 | 11/2010 | Walters | |
| 2023/0243225 | A1 | 8/2023 | Abel et al. | |
| 2024/0239148 | A1 * | 7/2024 | Torbati | B60G 13/14 |

FOREIGN PATENT DOCUMENTS

| | | | |
|---|---|---|---|
| CN | 220168476 | U | 12/2023 |
| UA | 14619 | U | 5/2006 |
| WO | 200408809 | A1 | 1/2004 |
| WO | 2008020168 | A1 | 2/2008 |
| WO | 2012085597 | A2 | 6/2012 |
| WO | 2013132269 | A1 | 9/2013 |

* cited by examiner

*Primary Examiner* — James G Sayre
(74) *Attorney, Agent, or Firm* — Vorys, Sater, Seymour and Pease LLP

(57) ABSTRACT

A downhole tool includes a housing, a shaft, a first one-way clutch, and a second one-way clutch. The shaft is disposed in the housing and axially moveable in a first axial direction and a second axial direction that is opposite of the first axial direction. The first one-way clutch is configured to clutch the shaft when the shaft moves in the first axial direction and configured to freewheel when the shaft moves in the second axial direction. The second one-way clutch is configured to clutch the shaft when the shaft moves in the second axial direction and configured to freewheel when the shaft moves in the first axial direction, wherein the first one-way clutch and second one-way clutch cooperate to cause the shaft to rotate in the same direction when the shaft is moved in either the first or second axial direction.

20 Claims, 7 Drawing Sheets

WIRELINE RECOVERY TOOL

FIELD OF THE DISCLOSURE

The present disclosure generally relates to wireline recovery tools for wireline fishing operations in a wellbore and, more specifically, to mechanically operable downhole wireline recovery tools.

BACKGROUND OF THE DISCLOSURE

Specialized tooling is often conveyed into a wellbore on flexible wirelines (e.g., electrified wirelines and/or non-electrified slicklines) for plugging, perforation, cleaning, and logging operations. However, during these wellbore operations there is a risk of damage to the wireline or the tooling, which can sometimes result in the wireline being cut or severed within the wellbore. When the wireline is severed, the tooling, and a section (length) of the wireline still attached to the tooling, may drop into the wellbore and become stuck or lost downhole. In such cases, wireline fishing operations are commonly undertaken to recover the wireline and connected tooling.

Based on the conditions and nature of the wireline lost in the wellbore, multiple recovery tools may be required for the wireline fishing operation. In many cases, retrieving the wireline requires a trial-and-error method of tool selection to identify a tool appropriate for the geometry and condition of the wireline. Conventional wireline recovery tools may include a rotatable spear to ensnare the lost wireline and may include an indexing mechanism to rotate the spear. The indexing mechanism may convert linear motion into rotational motion with a pin that rides within a tortuous index path defined in the tool. Indexing mechanisms, however, cause intermittent and stuttering rotation with a limited rotation angle per stroke of the indexing mechanism. Additionally, indexing mechanisms are prone to jamming due to the tortuous index path and/or debris becoming lodged in the index path.

Therefore, there exists a need for improved wireline recovery tools to recover lost wireline.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a downhole tool includes a housing, a shaft, a first one-way clutch, and a second one-way clutch. The shaft is disposed in the housing and axially moveable in a first axial direction and a second axial direction that is opposite of the first axial direction. The first one-way clutch is configured to clutch the shaft when the shaft moves in the first axial direction and configured to freewheel when the shaft moves in the second axial direction. The second one-way clutch is configured to clutch the shaft when the shaft moves in the second axial direction and configured to freewheel when the shaft moves in the first axial direction, wherein the first one-way clutch and second one-way clutch cooperate to cause the shaft to rotate in the same direction when the shaft is moved in either the first or second axial direction.

According to an embodiment consistent with the present disclosure, a downhole tool includes a housing, a shaft, a first one-way clutch, and a second one-way clutch. The shaft is disposed in the housing and axially moveable in a first axial direction and a second axial direction that is opposite of the first axial direction, the shaft having an exterior surface. The first one-way clutch is coupled to the housing and disposed about the shaft, wherein the first one-way clutch is configured to clutch the exterior surface when the shaft moves in the first axial direction and configured to freewheel when the shaft moves in the second axial direction. The second one-way clutch is coupled to the housing and disposed about the shaft, wherein the second-one way clutch is configured to clutch the exterior surface when the shaft moves in the second axial direction and configured to freewheel when the shaft moves in the first axial direction, wherein the first one-way clutch and second one-way clutch cooperate to cause the shaft to rotate in the same direction when the shaft is moved in either the first or second axial direction.

According to an embodiment consistent with the present disclosure, a wireline recovery tool includes a housing, a shaft, a spear, a first one-way clutch, and a second one-way clutch. The shaft is disposed in the housing and axially moveable in a first axial direction and a second axial direction that is opposite of the first axial direction. The spear is rotatably coupled to the shaft, the spear configured to become entangled with a wireline when rotated by the shaft. The first one-way clutch is configured to clutch the shaft when the shaft moves in the first axial direction and configured to freewheel when the shaft moves in the second axial direction. The second one-way clutch is axially spaced along the shaft from the first one-way clutch, wherein the second one-way clutch is configured to clutch the shaft when the shaft moves in the second axial direction and configured to freewheel when the shaft moves in the first axial direction, and wherein the first one-way clutch and second one-way clutch cooperate to cause the shaft to rotate in the same direction when the shaft is moved in either the first or second axial direction.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
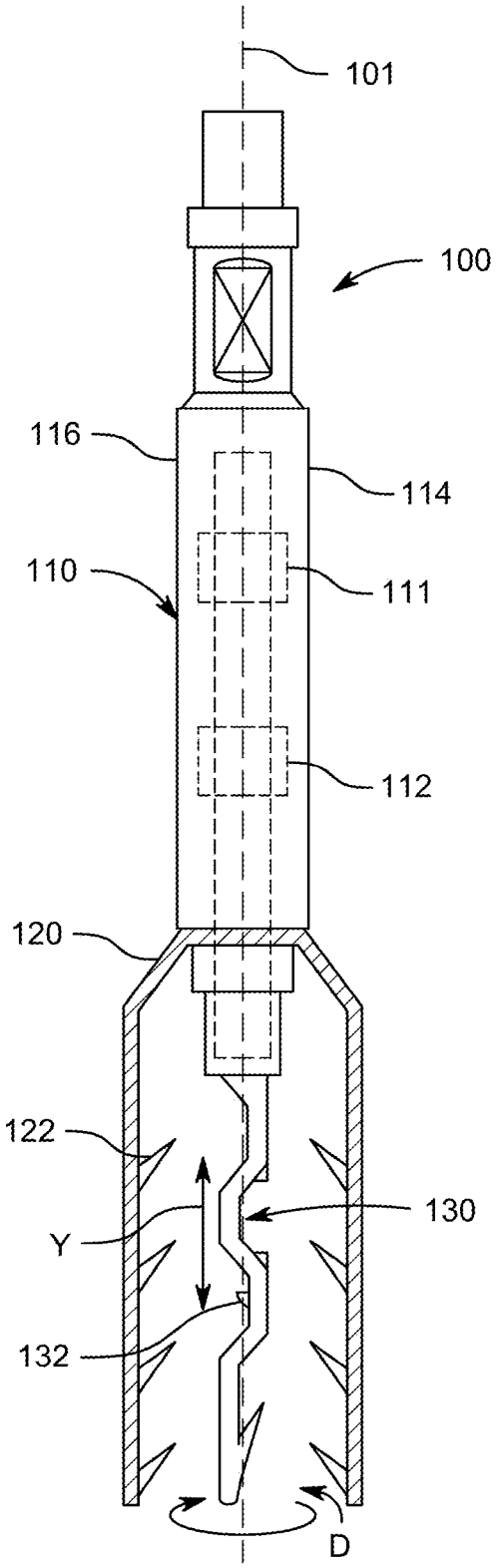
FIG. 1 is a schematic side view of a wireline recovery tool according to one or more example embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wireline recovery tools for wireline fishing operations and, more specifically, to mechanically operable downhole wireline recovery tools. Specifically, the embodiments of the wireline recovery tools disclosed herein may include at least two one-way clutches configured to allow axial movement of a shaft of the wireline recovery tool in both a first axial direction and a second axial direction. The two one-way clutches are arranged to cause the shaft to rotate in the same rotational direction whether the shaft is moving in the first or second axial direction.

In some embodiments, the two one-way clutches are axially spaced along the shaft. A first one-way clutch is arranged to drive rotation of the shaft while a second one-way clutch freewheels when the shaft moves in the first axial direction. The second one-way clutch is arranged to drive rotation of the shaft while the first one-way clutch freewheels when the shaft moves in the second axial direction, which may be opposite the first axial direction. Both one-way clutches drive the shaft to rotate in the same direction. In some embodiments, the one-way clutches are sprag clutches with pins that are receivable in a corresponding helical path in the shaft. In some embodiments, the shaft includes two helical paths, wherein each one of the helical paths corresponds to one of the one-way clutches. In some embodiments, the rotary motion of the shaft is used to rotate a spear to ensnare a broken wireline downhole.

Referring to FIG. 1, a wireline recovery tool 100 for recovering a wireline (not shown) lost in a wellbore is illustrated. The wireline may include a broken section (length) of wireline or slickline that is either loose or coupled to a downhole tool dropped into the wellbore.

The wireline recovery tool 100 may generally include a rotary assembly 110, an outer sheath 120, and a spear 130. The rotary assembly 110 is operable to facilitate rotation of the spear 130 about a longitudinal axis 101 of the wireline recovery tool 100, e.g., in a direction D. The rotary assembly 110 may also facilitate or permit axial translation of the spear 130 relative to the outer sheath 120, e.g., in direction Y. The rotation and axial translation of the spear 130 may help to ensnare (e.g., entangle) the wireline with the spear 130. The outer sheath 120 may include a plurality of prongs 122 extending radially inward therefrom. The prongs 122 may be angled relative to the longitudinal axis 101 and may extend in an uphole direction to facilitate entanglement with the wireline. The spear 130 may also include a plurality of barbs 132 to assist in ensnaring the wireline.

The rotary assembly 110 includes a first one-way clutch 111, a second one-way clutch 112 axially spaced from the first one-way clutch 111, and a shaft 114 that are each positioned within a housing 116. The shaft 114 may be rotationally coupled to the spear 130. The first and second one-way clutches 111, 112 are axially spaced along the housing 116 and are engageable with the shaft 114 to cause the shaft 114 to rotate as the shaft 114 moves axially in direction Y. As described in greater detail below, the shaft 114 may include a profile to facilitate engagement with the first and second one-way clutches 111, 112.

More specifically, the first one-way clutch 111 freewheels (e.g., is disengaged and rotates in response to axial motion of the shaft 114) as the shaft 114 moves in a first axial direction (e.g., negative Y direction, downhole direction). The first-one way clutch 111, however, engages (e.g., "clutches the shaft" or rotationally locks) as the shaft 114 moves in a second axial direction (e.g., positive Y direction, uphole direction) to cause the shaft 114 to rotate in a first rotational direction (e.g., clockwise direction). The second one-way clutch 112 freewheels as the shaft 114 moves in the second axial direction and engages as the shaft 114 moves in the first axial direction to cause the shaft 114 to also rotate in the first rotational direction. In other words, the shaft 114 will rotate in the same direction if moved in either of the first or second axial directions.

In other words, each of the first and second one-way clutches 111, 112 are arranged to freewheel while the other is engaged to convert the linear motion of the shaft 114 to rotational motion. The one-way clutches 111, 112, therefore, cause the shaft 114 to rotate in the same direction about the longitudinal axis 101 as the shaft 114 is stroked in either the first or second axial direction to rotate the spear 130. Additionally, the one-way clutches 111, 112 impart rotation to the shaft 114 continuously over each unit of axial movement unlike conventional indexing mechanisms which induce intermittent and stuttering rotation as the indexing member follows the tortuous indexing path. The continuous rotational motion may facilitate ensnaring the lost wireline.

In some embodiments, the shaft 114 is moved axially due to gravity and/or by engagement of the spear 130 with an object, such as a mass of wire, disposed in the wellbore. For example, the shaft 114 and spear 130 attached thereto may move (e.g., stroke) in the first axial direction (e.g., downhole direction) toward an extended position under the influence of gravity as the wireline recovery tool 100 is deployed into the wellbore. The shaft 114 is free to move in the second axial direction (e.g., uphole direction) once the spear 130 is engaged with the object in the wellbore due to the weight of the wireline recovery tool 100 acting on the shaft 114. The shaft 114 rotates as it moves in the second axial direction to ensnare the object due to the first and second one-way clutches 111, 112. Additionally, the shaft 114 may be stroked repeatedly during the same deployment, with the first and second one-way clutches 111, 112 allowing repeated axial movement while causing the shaft 114 to rotate in the same rotational direction.

In some embodiments, the first and second one-way clutches 111, 112 may be rigidly mounted to the housing 116 with the shaft 114 being disposed inside (extending through) the first and second one-way clutches 111, 112. The one-way clutches 111, 112 are engageable with the exterior of the shaft 114 to impart rotation. Alternatively, in other embodiments (not shown), the first and second clutches 111, 112 may be affixed to the housing 116 but disposed on the interior of the shaft 114. In these embodiments, the first and second one-way clutches 111, 112 would therefore be engageable with the interior of the shaft 114 to impart rotation.

The first and second one-way clutches 111, 112 may be any suitable one-way clutch which allows free rotation (e.g., freewheeling) with minimal to zero torque transfer to the shaft 114 as the shaft 114 moves in one axial direction while locking to impart rotation (e.g., transfer torque) to the shaft 114 as the shaft 114 moves in the opposite axial direction. For example, the first and second one-way clutches 111, 112 may be a freewheel clutch, such as sprag clutch. As another example, the first and second one-way clutches 111, 112 may be a ratchet and pawl that interacts with a profile, such as serrations, on the shaft 114. As another example, the first and second one-way clutches 111, 112 may include mechanisms such as a strap, a strop, or a chain that is engageable with the shaft 114. Additionally, while only one first and second one-way clutch 111, 112 are shown, the wireline recovery tool 100 may include more than one first one-way clutch 111 and more than one second one-way clutch 112. Increasing the number of one-way clutches 111, 112 increases the torque capacity of the wireline recovery tool 100.

Figure 2A:
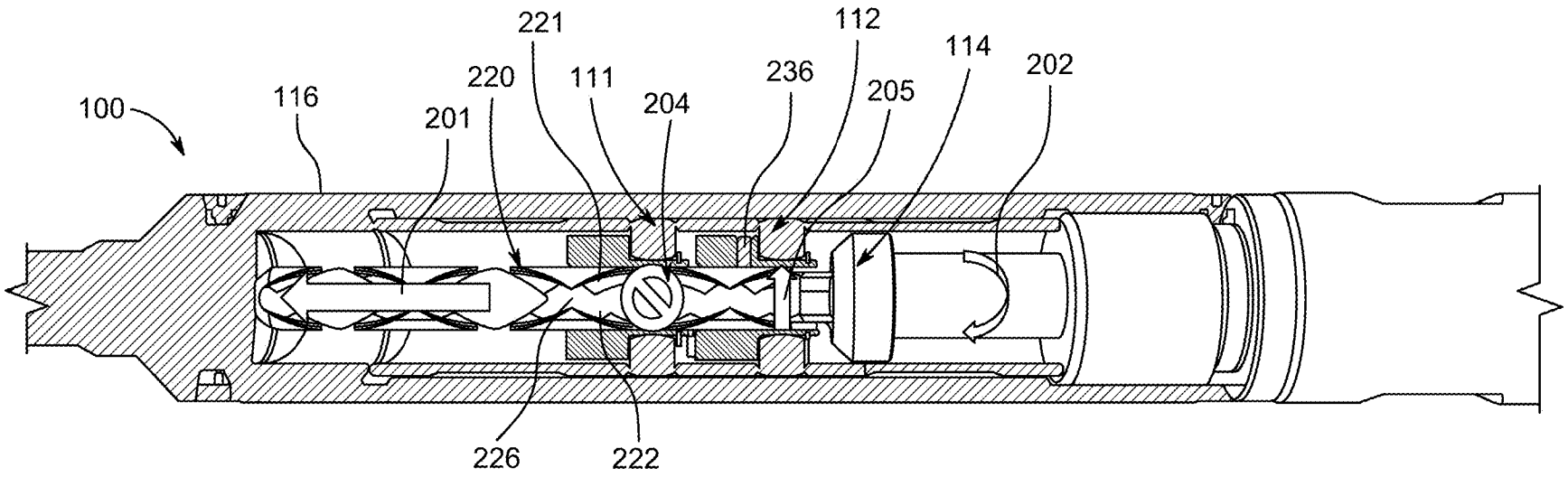
FIG. 2A is a partial cross-sectional view of a wireline recovery tool with a shaft in a retracted position according to one or more example embodiments of the present disclosure.
Figure 2B:
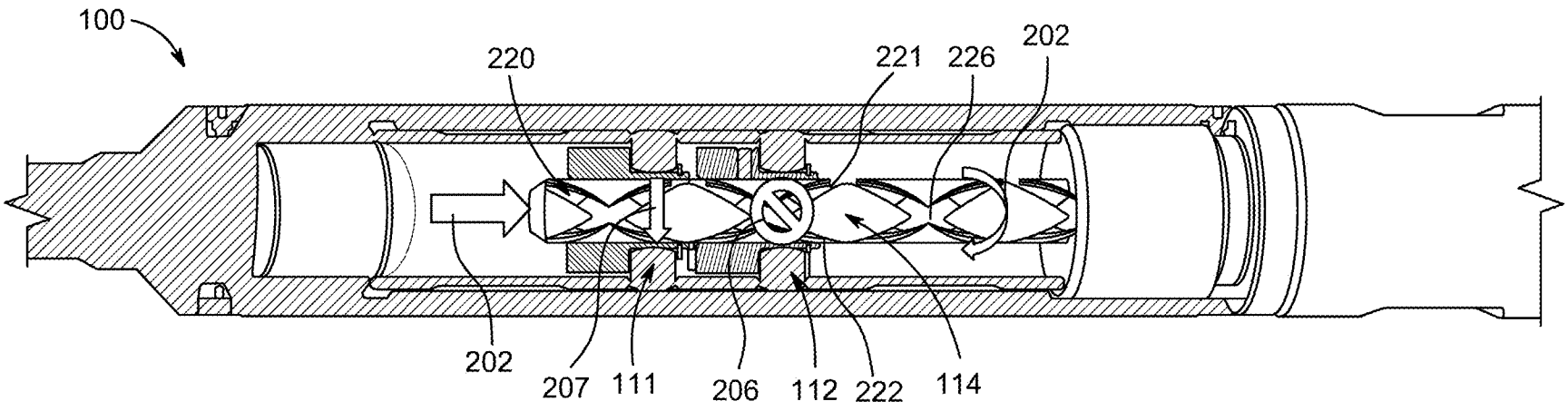
FIG. 2B is a partial cross-sectional side view of the wireline recovery tool of FIG. 2A with the shaft in an extended position according to one or more example embodiments of the present disclosure.

FIG. 2A illustrates an example embodiment of the wireline recovery tool 100 to show additional details of the present disclosure. FIG. 2A shows the shaft 114 in a fully retracted position relative to the housing 116 after being stroked in the first axial direction represented by the arrow 201. The first and second clutches 111, 112, shown schematically as sprag clutches, caused the shaft 114 to rotate in a first rotational direction as shown by arrow 202. The first clutch 111 locked to cause the rotation of the shaft 114 as shown by the "no symbol" 204 while the second clutch 112 freewheeled in a first freewheel direction as shown by the arrow 205. FIG. 2B illustrates the wireline recovery tool 100 after the shaft 114 is stroked in the second axial direction as indicated by arrow 202 to a fully extended position. The shaft 114 rotated in the same rotational direction as represented by arrow 202 as the shaft 114 stroked to the extended position due to the first and second one-way clutches 111, 112. The second clutch 112 locked to cause the rotation of the shaft 114 as shown by the "no symbol" 206 while the first clutch 111 freewheeled in a second freewheel direction as shown by the arrow 207.

Figure 2C:
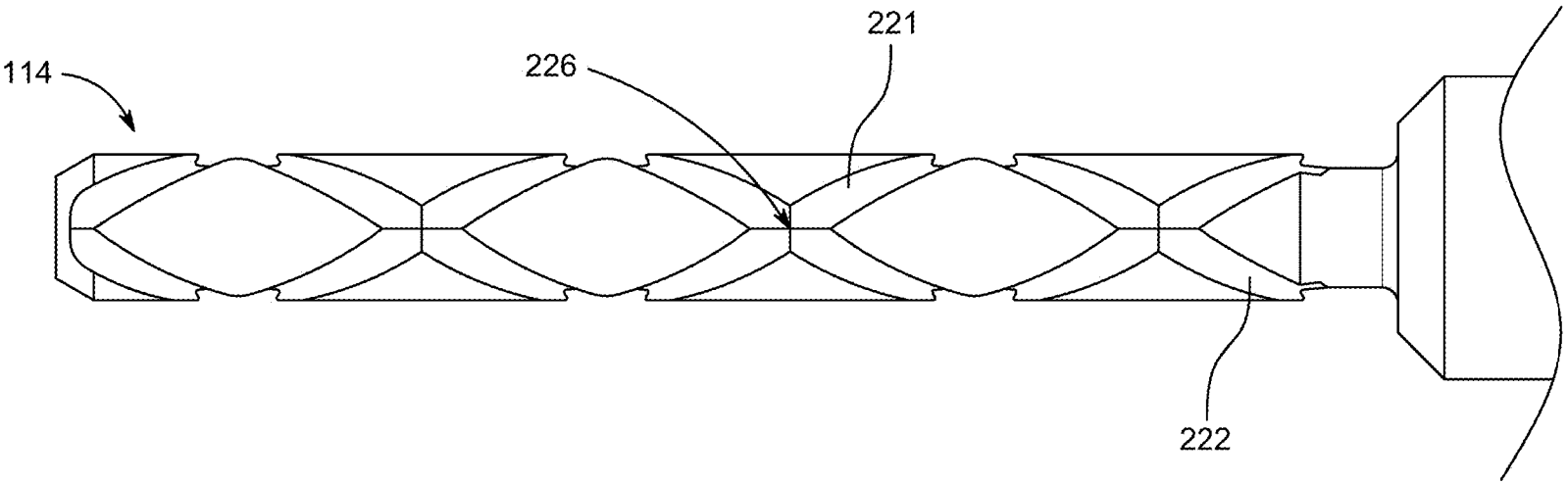
FIG. 2C is a side view of the shaft of the wireline recovery tool of FIG. 2A according to one or more example embodiments of the present disclosure.

FIGS. 2A-2B shows the shaft 114 as having a helical profile 220, and FIG. 2C illustrates a side view of the shaft 114 to better show the helical profile 220 with the other components of the wireline recovery tool 100 being omitted. The first and second one-way clutches 111, 112 are engageable with the helical profile 220. More specifically, the helical profile 220 includes a first helical groove 221 and a second helical groove 222 that periodically intersect one another at a convergence portion 226. The first helical groove 221 may be a clockwise groove while the second helical groove 222 is a counterclockwise groove, or vice versa. The first and second helical groves 221, 222 are shown as having a double helix arrangement such that the helical profile 220 is a double helix profile. In some embodiments, the first and second helical grooves 221, 222 may extend over the same length of the shaft 114, with the shaft 114 being constructed similarly to a self-reversing screw as shown in FIG. 2C. The first one-way clutch 111 may be configured to engage the first helical groove 221 (e.g., helical thread) while the second one-way clutch 112 may be configured to engage the second helical groove 222. For example, the first one-way clutch 111 may include one or more features 236 that slide within the first helical groove 221 while the second one-way clutch 112 includes one or more features 236 (obstructed from view) that slide within the second helical groove 222.

In some embodiments, the first and second helical grooves 221, 222 have the same pitch as shown in FIGS. 2A-2C. In other embodiments, the first and second helical grooves 221, 222 may have different pitches. For example, the first helical groove 221 may have a tighter (e.g., smaller) pitch as compared to the second helical groove 222 to facilitate a faster rotation speed of the shaft 114 when translated in the first axial direction as compared to the second axial direction.

Additionally, the first and second helical grooves 221, 222 may each have a varying pitch rather than a constant pitch as shown in FIG. 2C. A variable pitch facilitates a variable rotational speed of the shaft 114, and therefore the spear 130, at different points along the stroke of the shaft 114. For example, the pitch might be tightest at full extension and slacken at full retraction. The pitch may be selected to achieve a desired speed of rotation for any given linear speed of the shaft 114, a desired torque versus the linear position of the shaft 114, and the contact force between the shaft 114 and the one-way clutches 111, 112.

Figure 2D:
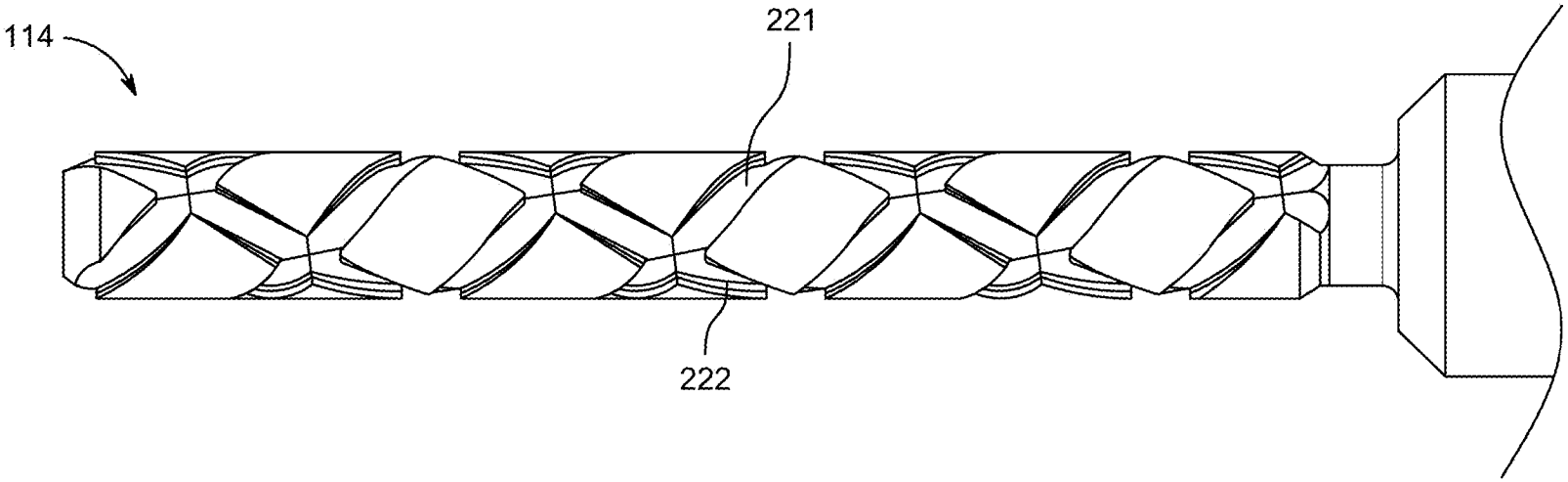
FIG. 2D is a side view of an alternative shaft of the wireline recovery tool of FIG. 2A with two helical grooves having different pitches.

In some embodiments, the first and second helical grooves 221, 222 may have different pitches. The different pitches may allow for different rotational speed depending on the direction of rotation of the shaft 114. As an example, FIG. 2D is a side view of the shaft 114 with the first and second helical grooves having different pitches. The first helical groove 221 has a larger pitch than the second helical groove 222, such as being twice as large. The different pitches cause the shaft 114 to rotate at one speed when stroked in the first axial direction and at a second speed when stroked in the second axial direction. For example, the shaft 114 may rotate twice as fast when stroked in the second axial direction as compared to stroking in the first axial direction due to the differing pitches of the first and second helical grooves 221, 222.

Figure 2E:
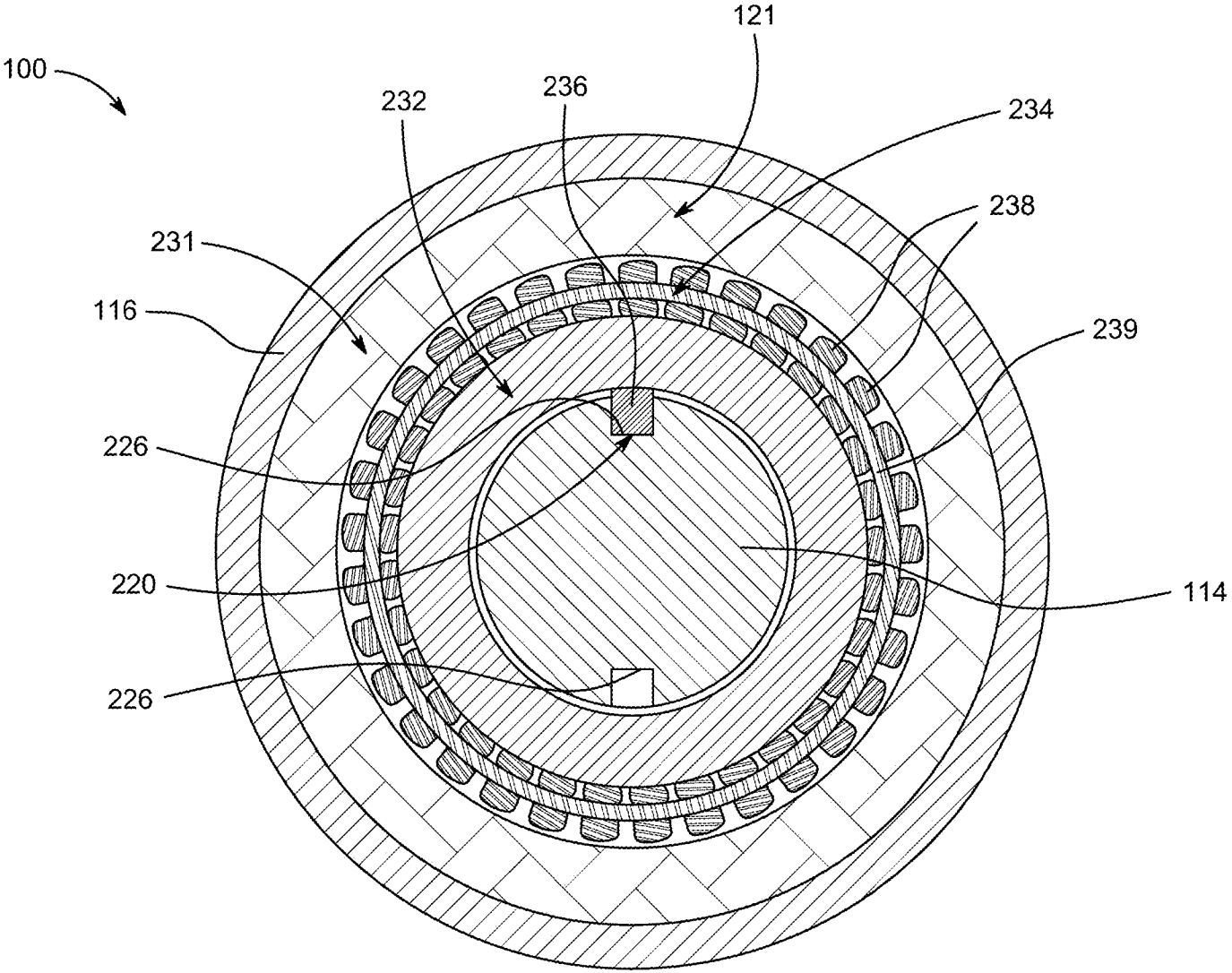
FIG. 2E is a cross-sectional end view of the wireline recovery tool of FIG. 2A illustrating a one-way clutch thereof according to one or more example embodiments of the present disclosure.

FIG. 2E illustrates a schematic cross-section of the wireline recovery tool 100 to show an example embodiment of the first one-way clutch 111. FIG. 2E shows the first-one way clutch 111 as a sprag clutch having an outer race 231, an inner race 232, and a cage 234 disposed between the inner and outer races 231, 232. The outer race 231 is affixed to the housing 116 while the inner race 232 is engaged with the shaft 114 by at least one feature 236 protruding from the inner race 232. While FIG. 2E shows the feature 236 as a pin, the feature 236 may be another element, such as a key. The feature 236 is shown extending into the helical profile 220 at the convergence portion 226 (also shown in FIG. 2C) where the first and second helical grooves 221, 222 intersect. The feature 236 slides in the first helical grove 221 as the shaft 114 moves axially. The torque capacity of the first one-way clutch 111 is based on the size of the feature 236, with a larger feature being capable of transferring more torque to the shaft 114. Increasing the number of features 236 increases the torque capacity of the first one-way clutch 111. Additionally, the feature 236 may clean (displace) any grit and debris that accumulates in the helical profile 220 since the first and second helical grooves 221, 222 do not have dead ends that trap grit and debris like a tortuous index path.

The cage 234 includes a plurality of sprags 238 arranged in a ring formation and coupled together by a biasing member 239. The sprags 238 and biasing member 239 interact such that rotation of the inner race 232 in one direction causes the sprags 238 to rotationally lock (e.g., clutch) the outer and inner races 231, 232 together while allowing the inner race 232 to rotate freely with respect to the outer race 231 when the inner race 232 rotates in the opposite direction. The shaft 114 is forced to rotate as it moves axially when the direction of axial travel causes the outer and inner races 231, 232 to lock together. Sprag clutches, such as the sprag clutch shown in FIG. 2E, are often sealed such that the clutch mechanism (e.g., biased sprags) is isolated from grit and/or debris which improves longevity of the wireline recovery tool 100 and also reduces jamming as compared to a conventional indexing mechanism which may be in communication with the wellbore fluids. The first one-way clutch 111 shown in FIG. 2E is representative of a similar embodiment of the second one-way clutch 112 except that the sprags 238 in the second one-way clutch may be oriented in an opposite orientation. Thus, the first and second clutches 111, 112 may rotationally lock in opposite directions and may also freewheel in directions opposite from one another.

Figure 3:
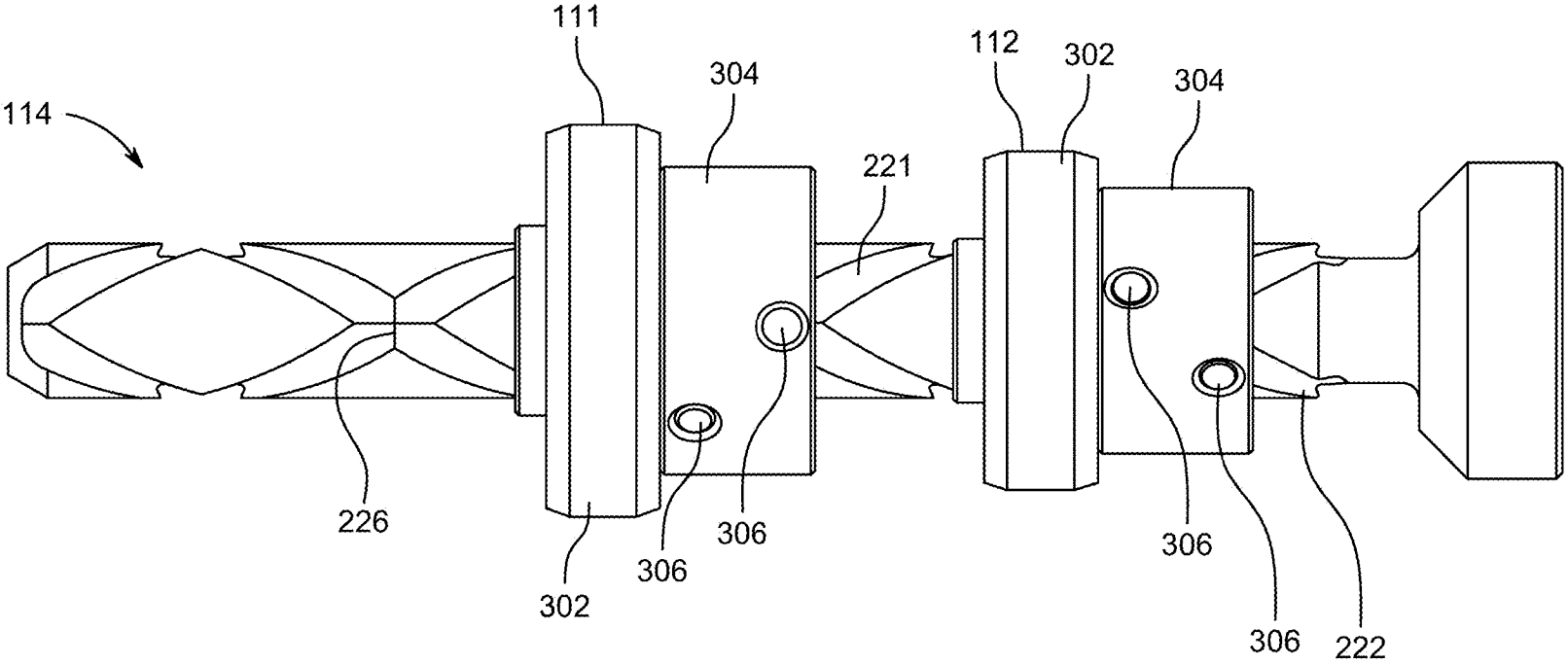
FIG. 3 is a side view of a shaft and two one-way clutches that may be employed in a wireline recovery tool according to one or more example embodiments of the present disclosure.

FIG. 3 illustrates an exemplary embodiment of the first and second one-way clutches 111, 112 about the shaft 114. The first and second clutches 111, 112 are once again shown as sprag clutches with an outer race 302 and an inner race 304. The inner race 304 is shown axially extending beyond the outer race 302. The inner race 304 also includes two features 306 which are shown as pins that are partially disposed in the corresponding first or second helical groove 221, 222. The features 306 of the first one-way clutch are arranged to inhibit one of the features 306 from entering the second helical groove 222. More specifically, the two features 306 are spaced such that one of the features 306 is disposed within the first helical groove 221 while the other feature 306 travels through the convergence portion 226. Therefore, the features 306 maintain the first one-way clutch 111 in engagement with the first helical groove 221 as the shaft 114 moves in either axial direction. The features 306 are of the second one-way clutch 112 are similarly arranged to maintain the second one-way clutch 112 in engagement with the second helical groove 222.

Figure 4A:
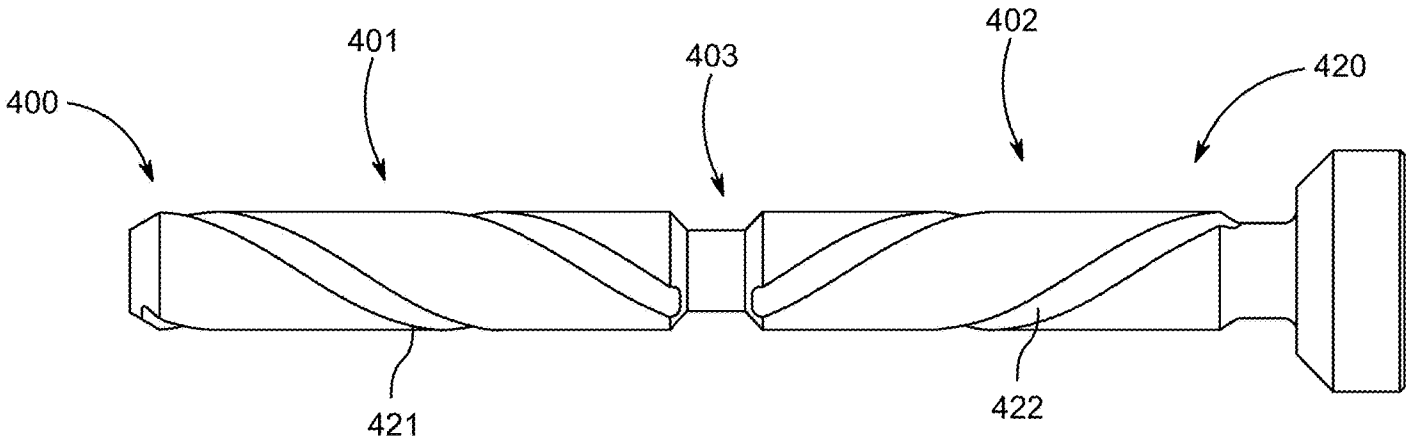
FIG. 4A is a side view of an alternate example of a shaft that may be employed in a wireline recovery tool according to one or more example embodiments of the present disclosure.

FIG. 4A illustrates a side view of an alternative embodiment of a shaft 400 that may be incorporated into a wireline recovery tool, such as being substituted for the shaft 114 in the wireline recovery tool 100. The shaft 400 has a first shaft portion 401 separated from a second shaft portion 402 by a third shaft portion 403. The first and second shaft portions 401, 402 are generally cylindrical and have a similar outer diameter. The third shaft portion 403 has a different outer diameter in some embodiments. For example, the third shaft portion 403 may be a circumferential groove formed in the shaft 114 as shown in FIG. 4A with a smaller outer diameter than the first and second shaft portions 401, 402.

A helical thread profile 420 is defined in the shaft 400, with a first helical groove 421 defined in the first shaft portion 401 and a second helical groove 422 defined in the second shaft portion 402. The first and second helical grooves 421, 422 may have the same or similar lengths, but the first and second helical grooves 421, 422 are axially offset from one another since each helical groove 421, 422 is formed on different portions of the shaft 400. This increases the length of the shaft 400 as compared to the shaft 114 shown in FIG. 2C where the first and second helical grooves 121, 122 are formed on the same portion of the shaft 114. The first helical groove 421 may be a clockwise groove while the second helical groove 421 is a counterclockwise groove, or vice versa. The first and second helical grooves 421, 422 may have the same or different pitches. Additionally, the pitch of the first and second helical groove 421, 422 may be constant or varied based on the design considerations.

Figure 4B:
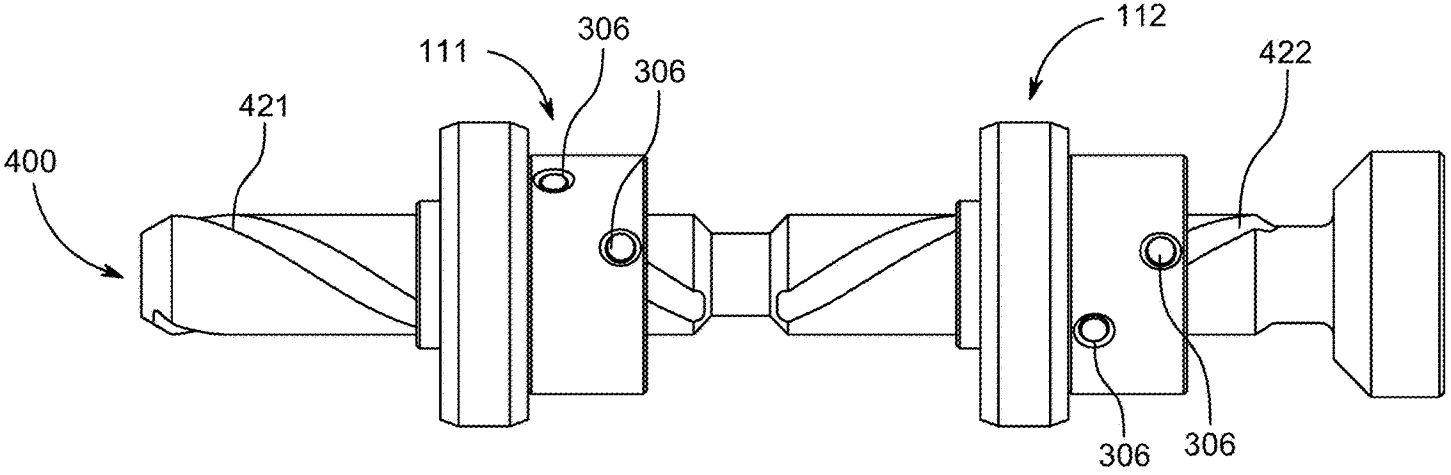
FIG. 4B is a side view of the shaft of FIG. 4A and two one-way clutches according to one or more example embodiments of the present disclosure.

FIG. 4B shows a side view of the shaft 400 disposed within (extending through) the first and second one-way clutches 111, 112. The first and second one-way clutches 111, 112 are shown as the sprag clutches from FIG. 3. The features 306 of the first one-way clutch 111 slide within the first helical groove 421 while the features 306 of the second one-way clutch 112 slide within the second helical groove 422. The first and second clutches 111, 112 similarly cause the shaft 400 to rotate in the same direction whether stroked in the first or second axial direction.

While embodiments of the present disclosure are described as being in relation to a wireline recovery tool, the arrangement of the shaft and at least two one-way clutches may be implemented in other downhole tools. For example, the two one-way clutches may be implemented into a wireline conveyed scraper tool which uses linear reciprocating motion converted to rotary motion to turn cutting faces to remove wellbore deposits. As another example, the two one-way clutches may be implemented into a tool to interface and tighten or loosen screw threaded joints in a wellbore using linear motion converted to rotary motion.

Embodiments disclosed herein include:

A. A downhole tool including a housing, a shaft, a first one-way clutch, and a second one-way clutch. The shaft is disposed in the housing and axially moveable in a first axial direction and a second axial direction that is opposite of the first axial direction. The first one-way clutch is configured to clutch the shaft when the shaft moves in the first axial direction and configured to freewheel when the shaft moves in the second axial direction. The second one-way clutch is configured to clutch the shaft when the shaft moves in the second axial direction and configured to freewheel when the shaft moves in the first axial direction, wherein the first one-way clutch and second one-way clutch cooperate to cause the shaft to rotate in the same direction when the shaft is moved in either the first or second axial direction.

B. A downhole tool including a housing, a shaft, a first one-way clutch, and a second one-way clutch. The shaft is disposed in the housing and axially moveable in a first axial direction and a second axial direction that is opposite of the first axial direction, the shaft having an exterior surface. The first one-way clutch is coupled to the housing and disposed about the shaft, wherein the first one-way clutch is configured to clutch the exterior surface when the shaft moves in the first axial direction and configured to freewheel when the shaft moves in the second axial direction. The second one-way clutch is coupled to the housing and disposed about the shaft, wherein the second-one way clutch is configured to clutch the exterior surface when the shaft moves in the second axial direction and configured to freewheel when the shaft moves in the first axial direction, wherein the first one-way clutch and second one-way clutch cooperate to cause the shaft to rotate in the same direction when the shaft is moved in either the first or second axial direction.

C. A wireline recovery tool including a housing, a shaft, a spear, a first one-way clutch, and a second one-way clutch. The shaft is disposed in the housing and axially moveable in a first axial direction and a second axial direction that is opposite of the first axial direction. The spear is rotatably coupled to the shaft, the spear configured to become entangled with a wireline when rotated by the shaft. The first one-way clutch is configured to clutch the shaft when the shaft moves in the first axial direction and configured to freewheel when the shaft moves in the second axial direction. The second one-way clutch is axially spaced along the shaft from the first one-way clutch, wherein the second-one way clutch is configured to clutch the shaft when the shaft moves in the second axial direction and configured to freewheel when the shaft moves in the first axial direction, and wherein the first one-way clutch and second one-way clutch cooperate to cause the shaft to rotate in the same direction when the shaft is moved in either the first or second axial direction.

Element 1: wherein the first and second one-way clutches are sprag clutches. Element 2: wherein the shaft further comprises a helical profile that has a first helical groove and a second helical groove, and wherein the first one-way clutch has at least one first feature extending into the first helical groove and the second one-way clutch has at least one second feature extending into the second helical groove. Element 3: wherein the first and second helical grooves have the same pitch. Element 4: wherein a pitch of the first and second helical grooves is constant over an entire length of the first and second helical grooves. Element 5: wherein the at least one first feature includes two first features and the at least one second feature includes two second features. Element 6: wherein the at least one first feature and the at least one second feature are pins. Element 7: wherein the first and second helical grooves are arranged in a double helix. Element 8: wherein the first and second helical grooves are axially spaced from one another, with the first helical groove formed on a first shaft portion, the second helical groove formed on a second shaft portion that is axially spaced from the first shaft portion by a third shaft portion, and wherein the third shaft portion includes a circumferential groove. Element 9: further comprising a sheath fixed to the housing and a spear rotationally coupled to the shaft and partially disposed within the sheath. Element 10: wherein the exterior surface of the shaft further comprises a helical profile that has a first helical groove and a second helical groove, and wherein the first one-way clutch has at least one first feature extending into the first helical groove and the second one-way clutch has at least one second feature extending into the second helical groove. Element 11: wherein the first and second helical grooves are arranged in a double helix. Element 12: wherein the first and second helical grooves are axially spaced from one another, with the first helical groove formed on a first shaft portion, the second helical groove formed on a second shaft portion that is axially spaced from the first shaft portion by a third shaft portion. Element 13: wherein the third shaft portion includes a circumferential groove interposing the first and second shaft portions. Element 14: wherein the shaft further comprises a helical profile that has a first helical groove and a second helical groove, and wherein the first one-way clutch has at least one first feature extending into the first helical groove and the second one-way clutch has at least one second feature extending into the second helical groove. Element 15: wherein the first and second helical grooves are arranged in a double helix. Element 16: wherein the first and second helical grooves are axially spaced from one another, with the first helical groove formed on a first shaft portion, the second helical groove formed on a second shaft portion that is axially spaced from the first shaft portion by a third shaft portion. Element 17: wherein the third shaft portion includes a circumferential groove interposing the first and second shaft portions.

By way of non-limiting example, exemplary combinations applicable to A, B, and C include: Element 2 with Element 3, Element 2 with Element 4, Element 2 with Element 5, Element 2 with Element 6, Element 2 with Element 7, Element 2 with Element 8, Element 10 with Element 11, Element 11 with Element 12, Element 12 with Element 13, Element 14 with Element 15, Element 14 with Element 16, and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A downhole tool, comprising:

a housing;

a shaft disposed in the housing and axially moveable in opposing first and second axial directions;

a first one-way clutch configured to clutch the shaft when the shaft moves in the first axial direction and configured to freewheel when the shaft moves in the second axial direction; and a second one-way clutch configured to clutch the shaft when the shaft moves in the second axial direction and configured to freewheel when the shaft moves in the first axial direction, wherein the first and second one-way clutches cooperate to cause the shaft to rotate in the same direction when the shaft is moved in either the first or second axial direction.

2. The downhole tool of claim 1, wherein the first and second one-way clutches are sprag clutches.

3. The downhole tool of claim 1, wherein the shaft further comprises a helical profile that has a first helical groove and a second helical groove, and wherein the first one-way clutch has at least one first feature extending into the first helical groove and the second one-way clutch has at least one second feature extending into the second helical groove.

4. The downhole tool of claim 3, wherein the first and second helical grooves exhibit the same pitch.

5. The downhole tool of claim 3, wherein a pitch of the first and second helical grooves is constant over an entire length of the first and second helical grooves.

6. The downhole tool of claim 3, wherein the at least one first feature includes two first features and the at least one second feature includes two second features.

7. The downhole tool of claim 3, wherein the at least one first feature and the at least one second feature are pins.

8. The downhole tool of claim 3, wherein the first and second helical grooves are arranged in a double helix.

9. The downhole tool of claim 3, wherein the first and second helical grooves are axially spaced from one another, with the first helical groove formed on a first shaft portion, the second helical groove formed on a second shaft portion that is axially spaced from the first shaft portion by a third shaft portion, and wherein the third shaft portion includes a circumferential groove.

10. The downhole tool of claim 1, further comprising a sheath fixed to the housing and a spear rotationally coupled to the shaft and partially disposed within the sheath.

11. A downhole tool, comprising:

a housing;

a shaft disposed in the housing and axially moveable in opposing first and second axial directions, the shaft having an exterior surface;

a first one-way clutch coupled to the housing and disposed about the shaft, wherein the first one-way clutch is configured to clutch the exterior surface when the shaft moves in the first axial direction and configured to freewheel when the shaft moves in the second axial direction; and a second one-way clutch coupled to the housing and disposed about the shaft, wherein the second-one way clutch is configured to clutch the exterior surface when the shaft moves in the second axial direction and configured to freewheel when the shaft moves in the first axial direction, wherein the first one-way clutch and second one-way clutch cooperate to cause the shaft to rotate in the same direction when the shaft is moved in either the first or second axial direction.

12. The downhole tool of claim 11, wherein the exterior surface of the shaft further comprises a helical profile that has a first helical groove and a second helical groove, and wherein the first one-way clutch has at least one first feature extending into the first helical groove and the second one-way clutch has at least one second feature extending into the second helical groove.

13. The downhole tool of claim 12, wherein the first and second helical grooves are arranged in a double helix.

14. The downhole tool of claim 12, wherein the first and second helical grooves are axially spaced from one another, with the first helical groove formed on a first shaft portion, the second helical groove formed on a second shaft portion that is axially spaced from the first shaft portion by a third shaft portion.

15. The downhole tool of claim 14, wherein the third shaft portion includes a circumferential groove interposing the first and second shaft portions.

16. A wireline recovery tool, comprising:

a housing;

a shaft disposed in the housing and axially moveable in opposing first and second axial directions;

a spear rotatably coupled to the shaft, the spear configured to become entangled with a wireline when rotated by the shaft;

a first one-way clutch configured to clutch the shaft when the shaft moves in the first axial direction and configured to freewheel when the shaft moves in the second axial direction; and a second one-way clutch axially spaced along the shaft from the first one-way clutch, wherein the second one-way clutch is configured to clutch the shaft when the shaft moves in the second axial direction and configured to freewheel when the shaft moves in the first axial direction, and wherein the first one-way clutch and second one-way clutch cooperate to cause the shaft to rotate in the same direction when the shaft is moved in either the first or second axial direction.

17. The wireline recovery tool of claim 16, wherein the shaft further comprises a helical profile that has a first helical groove and a second helical groove, and wherein the first one-way clutch has at least one first feature extending into the first helical groove and the second one-way clutch has at least one second feature extending into the second helical groove.

18. The wireline recovery tool of claim 17, wherein the first and second helical grooves are arranged in a double helix.

19. The wireline recovery tool of claim 17, wherein the first and second helical grooves are axially spaced from one another, with the first helical groove formed on a first shaft portion, the second helical groove formed on a second shaft portion that is axially spaced from the first shaft portion by a third shaft portion.

20. The wireline recovery tool of claim 19, wherein the third shaft portion includes a circumferential groove interposing the first and second shaft portions.

* * * * *